United States Patent [19]

Coplan et al.

[11] 4,315,877

[45] Feb. 16, 1982

[54] METHODS OF FABRICATING SORBENT-CORED TEXTILE YARNS

[75] Inventors: Myron J. Coplan, Natick; George Lopatin, Newton, both of Mass.

[73] Assignee: Albany International Corp., Albany, N.Y.

[21] Appl. No.: 157,102

[22] Filed: Jun. 6, 1980

Related U.S. Application Data

[62] Division of Ser. No. 14,071, Feb. 22, 1979, abandoned.

[51] Int. Cl.[3] ..... B29D 7/02

[52] U.S. Cl. ..... 264/45.9; 264/49; 264/173; 264/177 F; 264/209.5; 428/398

[58] Field of Search ..... 264/171, 209.5, 173, 264/177 F, 45.9, 49; 428/398

[56] References Cited

U.S. PATENT DOCUMENTS

| | | | |
|---|---|---|---|
| 2,932,079 | 4/1960 | Dietsch et al. | 264/171 |
| 2,965,925 | 12/1960 | Dietsch | 264/209 |
| 3,015,873 | 1/1962 | Dietsch et al. | 264/171 |
| 3,175,339 | 3/1965 | McDowell | 264/171 |
| 3,400,189 | 9/1968 | Nacke | 269/167 |
| 3,423,491 | 1/1969 | McLain et al. | 264/41 |
| 3,558,420 | 1/1971 | Opfell | 428/398 |
| 3,998,988 | 12/1976 | Shimomai et al. | 428/372 |
| 4,010,308 | 3/1977 | Wiczer | 428/398 |
| 4,020,230 | 4/1977 | Mahoney et al. | 428/398 |
| 4,055,696 | 10/1977 | Kamada et al. | 428/398 |
| 4,055,702 | 10/1977 | Guthrie et al. | 428/398 |
| 4,089,921 | 5/1978 | Dobo | 264/147 |
| 4,164,437 | 8/1979 | Henne et al. | 264/173 |
| 4,182,582 | 1/1980 | Youval et al. | 264/173 |

OTHER PUBLICATIONS

"Phase Separation Spinning of PP", Williams et al., SPE Journal, vol. 28, pp. 51–57 (1967).

"Preparation of High Clearance Sorbent-Filled Hollow Fibous", Hein, Gulf South Res. Zustitukerert, (7–77), p. 42.

*Primary Examiner*—Jay H. Woo

*Attorney, Agent, or Firm*—Kenway & Jenney

[57] ABSTRACT

Textile-quality multifilament yarns that are highly sorptive for organic vapors, mists and solutes are described. Each filament comprises a microporous polymeric sheath filled with a core of sorptive material. In a multifilament spinneret having a hollow needle in each orifice, a slurry containing the sorptive material is supplied to each needle, and a blend of a polymeric material and a pore-forming material is supplied to the orifice externally of the needle. The spun composite fibers are drawn and subsequently extracted to porosify the sheath and to activate the sorptive property of the cores.

19 Claims, 1 Drawing Figure

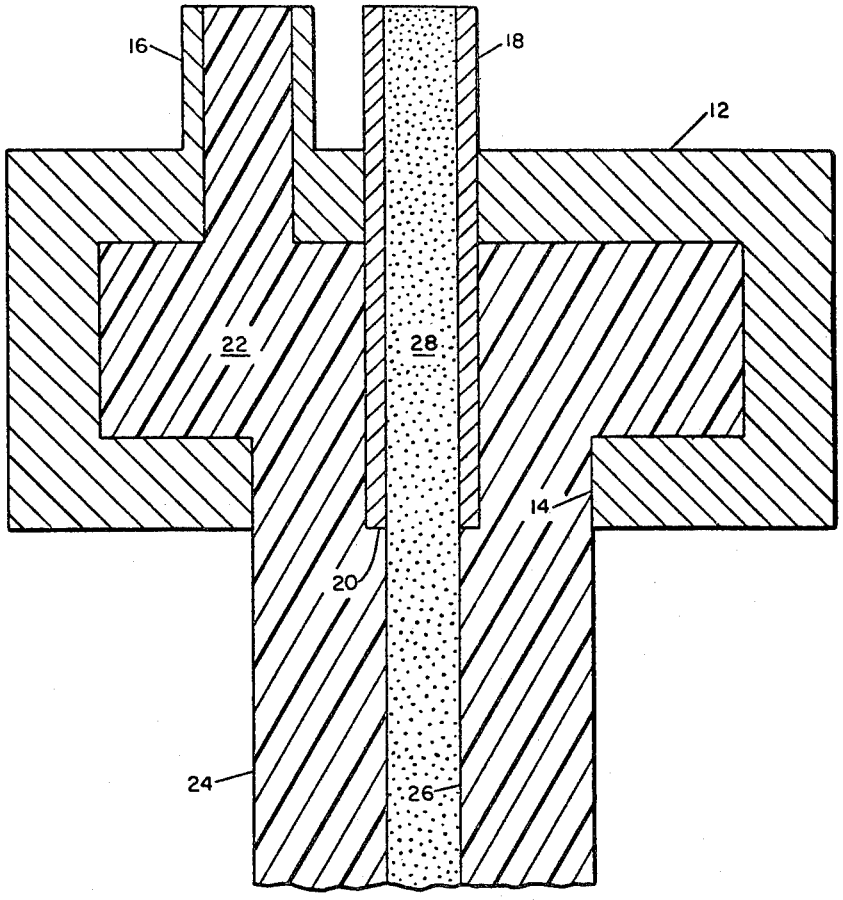
16
18
12
22
28
14
20
24
26

METHODS OF FABRICATING SORBENT-CORED TEXTILE YARNS

This is a division of application Ser. No. 14,071, filed Feb. 22, 1979 now abandonded.

BRIEF SUMMARY OF THE INVENTION

The invention described herein was made in the course of work under a grant or award from The Department of the Army.

This invention relates generally to textile quality yarns which are highly sorptive for organic vapors, aerosols, mists, solutes and noxious or harmful substances that are generally in these forms. More particularly, the invention relates to yarns that incorporate active sorptive materials within the fiber structure, and methods of fabricating such fibers.

A principal object of this invention is to produce filaments of polymeric composition incorporating sorptive materials, which may be incorporated in multifilament yarns having properties suitable for textile uses generally. Such properties include, for example, a denier satisfactory for fabric handle, adequate strength and durability. It is desirable that the fibers retain the sorptive constituents through use and cleaning, and that the sorptive properties may be renewed by cleaning processes.

An object of the invention is to provide fibers containing sorptive media, that is, species capable of taking up a significant percentage of the weight of such media in organic vapors or solutes, for use as protective clothing, coverings or the like. For this purpose it is important not only that the sorptive media are present in an active form, but also that the media comprise a significant percentage of the weight of the fibers in which they are contained.

As previously noted, it is important that the sorptive materials are securely retained within the body of the fibers so as not to be dislodged in ordinary usages. This in turn imposes a requirement upon the polymeric material comprising the fibers, namely, that such material must permit the ready diffusion of materials to be sorbed, so as to have ready access to the sorptive constituents.

In some cases, it is further desirable that the polymeric yarns have a hydrophobic property. This property, while permitting the passage of water vapor, will not permit the passage of liquid water; hence, body sweat, composed primarily of water and salts that attack some active sorptive materials, may be excluded.

Past efforts at incorporating sorptive materials in polymeric fibers or film-forming polymers have been characterized by the achievement of undesirably low levels of sorption capacity. One of the problems has been that when such sorptive materials as active carbon particles have been loaded in polymers, difficulties have arisen in spinning and drawing the filaments except at relatively low levels of carbon loading. As a result, carbon loading under ten percent has been frequently accepted as a limit for spun solid fibers. Another problem is that even this limited loading has been rendered partially ineffective by the fact that the polymer occludes access to the internal pore structure of the sorptive particles.

Sorbent fibers composed entirely of carbon have been produced, and while some of these do not exhibit the problems of occlusion mentioned above, they are very friable and thus not suitable for ordinary or typical textile uses.

Hollow tubules filled with powdered activated carbon and other sorbent substances have been described in the literature for use in blood purification. The tubules described, for example cellulose acetate, comprise non-porous materials having a degree of permeability to blood components. Sorption appears to depend upon the solubility and diffusion of the blood components through the tubule walls. The tubules are undrawn and have substantial outer diameters between 35 and 60 mils. These tubules also appear to be unsuitable for ordinary or typical textile uses.

With a view to achieving the above-mentioned objects and overcoming the limitations of the prior art, this invention features fine denier yarn filaments each comprising a microporous, hollow polymeric sheath, the lumen of the sheath containing a core of active sorptive material, the sorptive material comprising a significant portion of the weight of the fiber and being in a highly active sorptive state.

The invention also includes methods of fabricating such filaments, which are adapted to porosify the wall of the sheath and to prevent the occlusion of the sorptive filler by the polymer. According to this method, a particulate sorptive material is dispersed in a liquid carrier to form a slurry, the slurry forming a continuously extrudable core. A blend is separately prepared by melt-blending the polymer such as polypropylene with a pore-forming material such as paraffin wax. The blend and slurry are then pumped and metered in separate streams into a needle-in-orifice type multifilament hollow fiber spinneret to form the composite filaments. The filaments are then drawn in one or more further steps.

According to further features, the slurry and blend are respectively prepared in a manner to ensure extrudable properties through the spinneret.

After the filament is formed, the product is extracted in one or more steps for removal of the carrier liquid forming the slurry, and of the pore-forming material. This extraction porosifies the wall of the sheath and regenerates or reactivates the sorptive material.

Further features of the product and process comprise particular features and steps, as well as compositions and combinations of materials and processes hereinafter described.

BRIEF DESCRIPTION OF THE DRAWING

The drawing depicts a needle-in-orifice spinneret in schematic form for purposes of illustrating the general method of forming sorbent-cored textile filaments.

DETAILED DESCRIPTION

The drawing schematically depicts in cross section a spinneret body 12 having an orifice 14. A fitting 16 is provided for connection to a polymer extruder. A needle 18 having an open end 20 situated centrally of the orifice 14 is adapted for connection to a source of core slurry under suitable pressure. In operation, a blend 22 of polymer and pore-forming material is extruded to form a sheath 24 having a lumen 26, and this lumen is simultaneously filled with a slurry 28 comprising particulate sorptive material in a liquid carrier.

In a preferred example, the slurry is made by dispersing in a colloid mill active carbon particles, pulverized to less than 325 mesh, in triethylene glycol. Preferably, the carbon is added progressively during the milling until it comprises approximately 25 percent by weight of the total slurry. The slurry is then sieved with the aid of a brush through an 80-mesh screen in order to remove any large particles that might obstruct the flow of the slurry through the needle 18. The triethylene glycol is chosen as an extractable vehicle that will suitably carry the carbon particles, and as a liquid having a sufficiently high boiling point to prevent flashing in the needle 18, that is, vaporization in the presence of the heated polymer blend 22. It may also be preferred in some cases to heat the slurry to above the extrusion temperature of the blend. For example, with a polypropylene and wax blend, the slurry is preferably heated to 180 degrees C. under a nitrogen gas sweep in order to remove any low boiling constituents such as water and ethylene glycol.

A melt blend is separately prepared suitably for extrusion and comprises polypropylene and a paraffin wax having a melting point of approximately 55 degrees C., the wax comprising for example 30 percent by weight of the total blend. The wax is chosen for its ability to separate out of the polymer upon cooling, and thereby to leave voids or pores that are mutually interconnected after subsequent extraction of the wax.

The blend and the slurry are then pumped and metered in separate streams to the connections 16 and 18, and extruded at approximately 170 degrees C. In this example the orifice 14 has a diameter of 0.070 inch and the inner diameter of the needle 18 is approximately 0.015 to 0.020 inch. A multifilament yarn is produced by a 12-hole multifilament spinneret of the type described. The extruded hollow filament 24 with the blend forming the wall or sheath and the slurry forming the core is spun down a 15-foot cooling stack, and taken up in a conventional manner with a melt spin draw exceeding a ratio of 10:1, preferably about 100:1 or greater.

Preferably, in the above example utilizing polypropylene and paraffin wax, the yarn is then further "cold drawn" 5:1 at a temperature below the melting point of the polypropylene, preferably about 100 degrees C., in a water bath at approximately 350 feet per minute take-up speed. This cold drawing step may be to a ratio anywhere between 2:1 and 20:1, as desired.

After the drawing steps, the filaments are subjected to extraction for removal of the carrier forming the slurry, in this case triethylene glycol, and the pore-forming material, in this case paraffin wax. The extraction may be carried out either before or after the yarn is processed into a fabric. It has been found that the yarns must be restrained against longitudinal shrinkage during extraction to limit the degree of shrinkage.

A preferred method of extraction comprises a first step consisting of a room temperature pentane wash to extract the wax from the fiber walls, and thereby to porosify the walls. In a subsequent step, the fibers are subjected to a boiling methanol wash to extract most of the triethylene glycol from the core. This wash readily reaches and removes this vehicle through the porous fiber wall, thereby reactivating the carbon particles.

In some cases, a further extraction step may be performed. This comprises an extraction with pentane to remove the last traces of triethylene glycol from the core. For example, the fibers or fabric may be subjected to a plurality of rapid alternate pentane and methanol or pentane and boiling water washes, these washes effectively extracting all of the wax and triethylene glycol from the fibers and allowing the entire extraction procedure to be carried out continuously.

Yarns produced according to this invention are multifilament yarns, the denier per filament having a value anywhere in the range of 2 to 30. Excellent results have been obtained at deniers of 6 to 7 per filament. The diameter of the individual filaments, after drawing as described in the above example, is approximately 0.002 inch, whereas if they were ordinary solid and dense polypropylene filaments, they would have deniers around 16. Filament diameters between 0.001 and 0.01 inch may be produced in the practice of this invention. The lower deniers achieved result from the microporous character of the filament sheath as well as the low bulk density of the active carbon in the core. The bulk density of the carbon powder used to form the slurry in the above example is approximately 0.25 gram per cubic centimeter. In textile applications, the denier of the filaments appears satisfactory for fabric handle. In fabrics, the yarns may be plied two or more times to attain greater coarseness while retaining the high surface area of fine filaments.

Tenacity values of yarns produced according to the above example vary between 2.1 and 2.8 grams per denier, with elongations to break between 20 percent and 30 percent. It was observed that samples that had undergone high shrinkage during extractions had lower tenacities with correspondingly higher elongations.

The porosity of the yarns produced according to the above example was substantial as compared with previously known yarns. The permeability rate for organic substances such as carbon tetrachloride and methanol was more than ten times higher than for water vapor, the rate of water vapor measuring about 3,000 grams per square meter-day. The permeability rate was measured by spinning hollow filaments from the polymer-diluent blend under the same conditions as described above for the sorbent filled hollow fibers. After extraction the hollow filaments were filled with water or the organic fluid of test, sealed at the ends and the rate of weight loss measured as the contained fluid passed through the walls and evaporated. The higher permeability rate for organic liquids would be expected for a hydrophobic material such as polypropylene. Because of this hydrophobic character, although water vapor passes through the walls, liquid water does not. In clothing applications, this has the advantage that laundering can be accomplished without deactivating the active carbon in the core, and also it tends to prevent body sweat, composed primarily of water and salts, from affecting the sorbency of the fibers. Such salts may attack and tend to deactivate some active carbon fiber systems.

The absorption capacity of the yarns for carbon tetrachloride is generally about 40 percent of the original weight of the yarns, and on some samples it has reached 60 percent. In general, higher percentages are attained with higher carbon loading of the filaments and optimum control of extraction and drawing conditions. Dynamic absorption measurements have also shown high sorption characteristics for the described yarns.

In the practice of this invention the sorptive material comprises a large percentage of the weight of the fibers. For example, activated carbon may comprise between 20 and 70 percent by weight of the fiber, the process being otherwise the same as that described above in the preferred example.

Materials other than those described in the particular example above may be substituted if desired. For example, although active carbon is a frequently preferred sorptive material for many applications, other sorptive materials such as silica gel or any of the molecular sieve type materials in common use may be substituted.

Also, other carriers for the sorptive particles may be substituted for the triethylene glycol, subject to the desired properties including resistance to vaporization in the needle 18, extractability through the microporous wall of the filament and general suitability of the slurry for flow and extrusion through the needle. For example, molten paraffin wax may be used as a carrier for the carbon, with carbon loadings to 30 percent or higher. In such case the pentane extraction of the carrier for the carbon and the pore-forming material in the sheath occurs simultaneously, since both of these components comprise wax.

The slurry may in some cases contain a binder for the sorptive particles in addition to the carrier. For example, the slurry may comprise active carbon, polypropylene as a binder and a paraffin wax carrier. In this case a high level of carbon activity has been attained with polypropylene comprising as much as 18 percent by weight of the slurry.

Likewise, other polymers may be substituted for the polypropylene as the polymeric material comprising the porous sheath. These may be selected from any of the materials hitherto employed in the manufacture of polymeric fibers if adapted for melt blending, spinning and drawing in the manner hereinabove described.

Satisfactory pore-forming materials may include crystallizable compounds of various types or other compounds which will separate into discrete phases on cooling, which compounds are familiar to those skilled in this art, as well as the wax described. These pore forming materials should have compatibility with the polymer at extrusion temperatures. The pore forming material selected may comprise anywhere from 5 to 50 percent by weight of the melt blend.

Fabrics made according to this invention can be regenerated after use by methods that are well known. For example, they may be subjected to steam which will remove phenols as well as other toxic substances that may have been absorbed by the fibers.

We claim:

1. The method of forming textile yarn filaments including the steps of cospinning through an orifice and a hollow needle therein and drawing a core comprising a slurry of particulate sorptive material in a liquid carrier with a surrounding sheath comprising a blend of a polymeric material and an open-cell pore-forming material which is compatible with the polymeric material during cospinning and incompatible therewith to form a discrete phase after leaving the orifice, said drawing reducing the outer diameter of the extrudate to between 0.001 and 0.01 inch, extracting the pore-forming material to porosify the sheath of the resulting filament, and extracting the liquid carrier from the core of the filament.

2. The method according to claim 1, in which the cospinning includes melt-blending the polymeric material and the pore-forming material.

3. The method according to claim 1, in which the liquid carrier is selected to exclude low boiling constituents capable of flashing during cospinning.

4. The method according to claim 1, in which the slurry comprises activated carbon in triethylene glycol.

5. The method according to claim 4, in which the slurry is heated prior to cospinning to a temperature sufficient to cause substantial removal of ethylene glycol traces and water.

6. The method according to claim 1, in which the slurry is sieved prior to cospinning.

7. The method according to claim 1, in which the pore-forming material is crystallizable.

8. The method according to claim 1, in which the pore-forming material comprises paraffin wax.

9. The method according to claim 1, in which the pore-forming material comprises between 5 and 50 percent by weight of the melt blend.

10. The method according to claim 2, including melt drawing the filament to a ratio exceeding 10:1.

11. The method according to claim 1, including spin drawing the filament and thereafter further drawing the filament in a liquid bath.

12. The method according to claim 8, in which the paraffin wax is extracted with pentane.

13. The method according to claim 4, in which the triethylene glycol is extracted with methanol.

14. The method according to claim 4, in which the triethylene glycol is extracted with boiling methanol followed by a furtehr extraction with pentane.

15. The method according to claim 1, in which the pore-forming material and liquid carrier are simultaneously extracted.

16. The method according to claim 15, in which the pore-forming material comprises paraffin wax, the liquid carrier comprises triethylene glycol, and the wax and triethylene glycol are extracted by a plurality of pentane and methanol washes.

17. The method according to claim 15, in which the pore-forming material comprises paraffin wax, the liquid carrier comprises triethylene glycol, and the wax and triethylene glycol are extracted by a plurality of pentane and water washes.

18. The method according to claim 4, in which the triethylene glycol is extracted with boiling water followed by drying.

19. The method according to claim 1, including the step of drawing the extrudate to a ratio between 2:1 and 20:1 at a temperature below the melting point of the polymeric material.

* * * * *